US008864051B2

(12) United States Patent
Lin

(10) Patent No.: US 8,864,051 B2
(45) Date of Patent: Oct. 21, 2014

(54) ROTARY SPRAYING DEVICE

(75) Inventor: Wei Jen Lin, Taipei (TW)

(73) Assignee: Strong Fortress Tool Co., Ltd., Taipei (TW)

( * ) Notice: Subject to any disclaimer, the term of this patent is extended or adjusted under 35 U.S.C. 154(b) by 158 days.

(21) Appl. No.: 13/172,486

(22) Filed: Jun. 29, 2011

(65) Prior Publication Data

US 2012/0286065 A1 Nov. 15, 2012

(30) Foreign Application Priority Data

May 11, 2011 (TW) ..... 100116559 A

(51) Int. Cl.
*B05B 3/04* (2006.01)
*B05B 7/24* (2006.01)
*B05B 7/06* (2006.01)

(52) U.S. Cl.
CPC ..... *B05B 3/0409* (2013.01); *B05B 7/2435* (2013.01); *B05B 3/0427* (2013.01); *B05B 7/066* (2013.01)
USPC ..... 239/240; 239/314; 239/318

(58) Field of Classification Search
CPC .. B05B 3/0409; B05B 3/0422; B05B 3/0427; B05B 7/066; B05B 7/2435; B05B 7/2443; B05B 7/2448; B05B 7/2454
USPC ..... 239/233, 237, 240, 243, 245, 251, 261, 239/262, 380–383, 310, 314, 318
See application file for complete search history.

(56) References Cited

U.S. PATENT DOCUMENTS 6,109,546 A * 8/2000 Ormiston ..... 239/245
8,336,789 B2 * 12/2012 Kuo ..... 239/226
2010/0320289 A1 * 12/2010 Kuo ..... 239/290

* cited by examiner

*Primary Examiner* — Christopher Kim
(74) *Attorney, Agent, or Firm* — Cheng-Ju Chiang

(57) ABSTRACT

Disclosed is a rotary spraying device in which a fluid tube is assembled with a rotary means formed to have a channel structure. A portion of a fluid which flows through the fluid tube flows into the rotary means so as to provide a rotation applying force for rotating the rotary means when the fluid flows through the channel structure in the rotary means. Thus, the fluid is sprayed rotatably from the fluid tube which is rotated with the rotary means.

10 Claims, 8 Drawing Sheets

ROTARY SPRAYING DEVICE

FIELD OF THE INVENTION

The present invention relates to a spraying gun, and more particularly to a rotary spraying device driven by a rotary means thereof.

BACKGROUND OF THE INVENTION

Many spraying guns have been used widely for cleaning dust and dirt from a surface of an object, for watering, for spraying paint, and the like. The spraying guns remove dust and dirt by spraying a high pressure fluid, and perform watering and spraying paint with the use of a high pressure fluid mixed with water or other spraying liquid.

In order to uniform the spraying distribution, the spraying gun is manufactured to have a spraying tube with a bending shape and a rotating device is provided to couple with the spraying tube of the spraying gun. When rotating the spraying tube by the rotating device, a mixed fluid of a high pressured gas and a spraying liquid can be sprayed out in e in every direction with the rotation of the spraying tube. For example, the rotating device may be a fan having a plurality of fan blades, so as to be rotated by turning, by the high pressured gas introduced into the spraying gun, the fan blades. Alternatively, the rotating device may be a motor which is driven by power supplying, so as to make the spraying tube rotating.

However, because the fan blade has complicated structure and has low structural strength, the rotating device, which is a fan, is more difficultly in manufacturing and miniaturizing, and is easily damaged and deformed. The motor needs power supplying for operation so the rotating device wastes in production cost and power consumption.

SUMMARY OF THE INVENTION

In view of the above circumstances, the spraying tube is rotated by a fan or a motor according to a prior art of the spraying gun, so that the spraying gun is difficult in manufacture and costly in production.

Therefore, it is an object of the present invention to provide a rotary spraying device with stronger structure which is also easy in manufacturing and is stable in rotating.

The present invention overcomes the drawbacks of the prior art, and provides a rotary spraying device comprising: a fluid tube provided at one end thereof with a fluid inlet and the other end thereof with a spraying outlet, and a through hole provided on a tube wall of the fluid tube; a rotary means, coupled with the fluid tube, provided with a drive wall inclining to a fluid output direction of the through hole and an outflow passage formed at an end of the drive wall, where the drive wall is driven and pushed by a force of fluid output from the through hole via a fluid connection by a flow space; and a conveying tube provided at one end thereof with a fluid container inlet for connecting to a fluid container, and an end portion the of the conveying tube being disposed within the fluid tube to extend to the spraying outlet of the fluid tube.

In a preferred embodiment of the present invention, the drive wall of the rotary means is formed extending along an involute curve.

In a preferred embodiment of the present invention, the rotary means is further provided with a plurality of fastening ribs extending toward the fluid tube.

In a preferred embodiment of the present invention, the rotary means includes a front fastening layer, a back fastening layer, and a flow channel layer disposed therebetween.

Besides, said front fastening layer and said back fastening layer are made of a rigid material and said flow channel layer is made of a plastic material.

In a preferred embodiment of the present invention, the fluid tube is further provided inside with a splitter for splitting the fluid flowing through the fluid tube into two portions, wherein one portion of the fluid flows toward the spraying outlet of the fluid tube and the other portion of the fluid flows toward the through hole of the fluid tube.

In a preferred embodiment of the present invention, the conveying tube is further provided inside with a flow rate regulating means including a water stopper and a seal member, the water stopper is formed with a flow hole and the seal member is formed at one end thereof with a decreasing section movably disposed in the flow hole of the water stopper.

In a preferred embodiment of the present invention, the rotary spraying device further comprising a rotation speed adjusting means including a first adjusting member and a second adjusting member, wherein the first adjusting member is connected with the outflow passage of the rotary means and has an outlet surface formed with a plurality of first openings and the second adjusting member has an inlet surface coupled with the outlet surface of the first adjusting member to rotate with first adjusting member, and the inlet surface is formed with a plurality of second openings corresponding to the first openings.

Thereby, the fluid tube can be rotated without power supplying. The rotary means is stronger in structure and is easy in miniaturizing because the drive wall, the outflow passage, the flow space and so on are formed inside the rotary means. Further, the rotary means having such structure can be stable in rotating and rotate uniformly in high speed with low variation, and those effects are good for fluid spraying.

BRIEF DESCRIPTION OF THE DRAWINGS

The structure and the technical means adopted by the present invention to achieve the above and other objects can be best understood by referring to the following detailed description of the preferred embodiments and the accompanying drawings.

DETAILED DESCRIPTION OF THE PREFERRED EMBODIMENTS

Figure 1:
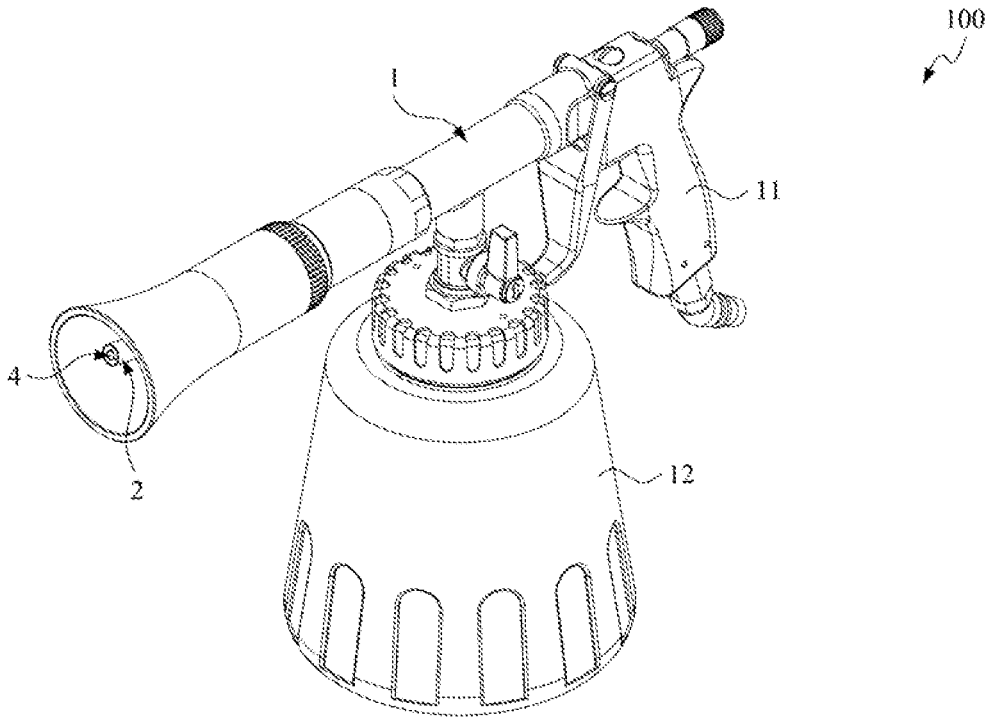
FIG. 1 is a perspective view illustrating an embodiment according to the present invention.
Figure 2:
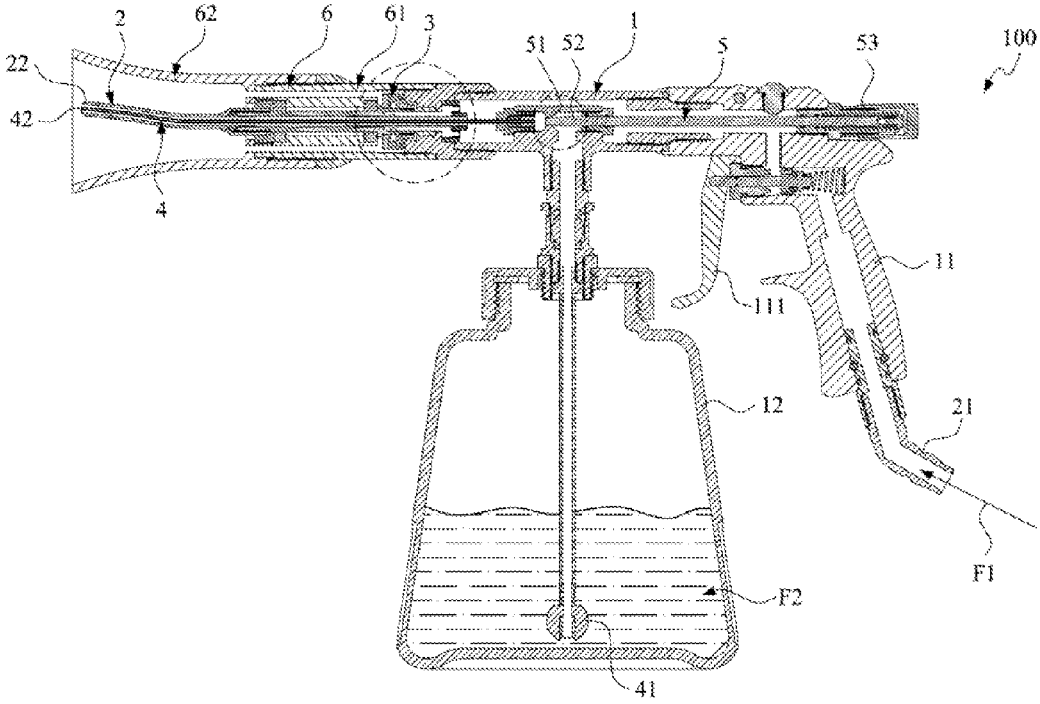
FIG. 2 is a cross-section view of FIG. 1.
Figure 3:
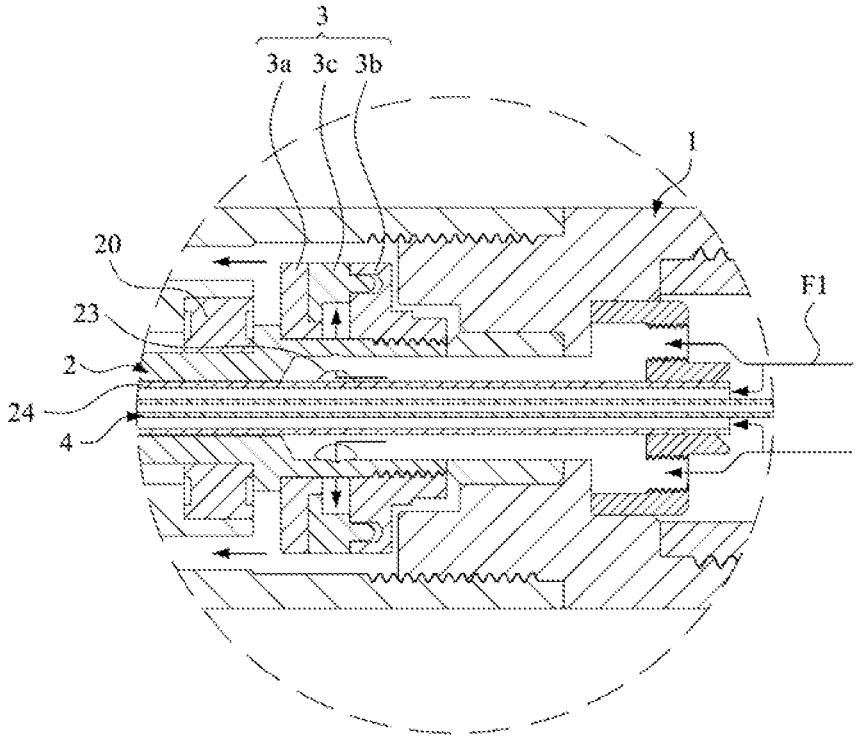
FIG. 3 is a partial enlarged view of FIG. 2.

Please refer to FIGS. 1-3. FIG. 1 is a perspective view illustrating an embodiment according to the present invention, FIG. 2 is a cross-section view of FIG. 1, and FIG. 3 is a partial enlarged view of FIG. 2. According to an embodiment of the present invention, a rotary spraying device 100 comprises a body 1 provided at an end thereof with a control handle 11 and a lower portion thereof with a fluid container 12.

A fluid tube 2, which is provided in the body 1, is assembled to the body 1 with a bearing 20, so as to rotate with an axial of the fluid spraying device 100. The fluid tube 2 is provided at one end with a fluid inlet 21 extending within the control handle 11. The other end of the fluid tube 2 is provided with a spraying outlet 22 extending to an opposite side of the body 1. A fluid F1 input from the fluid inlet 21 will be output from the spraying outlet 22.

Further, a rotary means 3, provided in the body 1, is coupled with the fluid tube 2, so that the fluid tube 2 can be rotated with the rotary means 3 together to process rotary spraying.

Furthermore, a conveying tube 4, provided in the body 1, is provided at one end with a fluid container inlet 41 connecting with the fluid container 12 and an end portion of the conveying tube 4 is a contained fluid outlet 42 which is disposed within the fluid tube 2 and extends to the spraying outlet 22 of the fluid tube 2. When fluid F1 is sprayed out from the spraying outlet 22 of the fluid tube 2, Venturi effect is induced, which effectively makes a contained fluid F2 in a container 12 being sprayed from the conveying tube 4.

Figure 4:
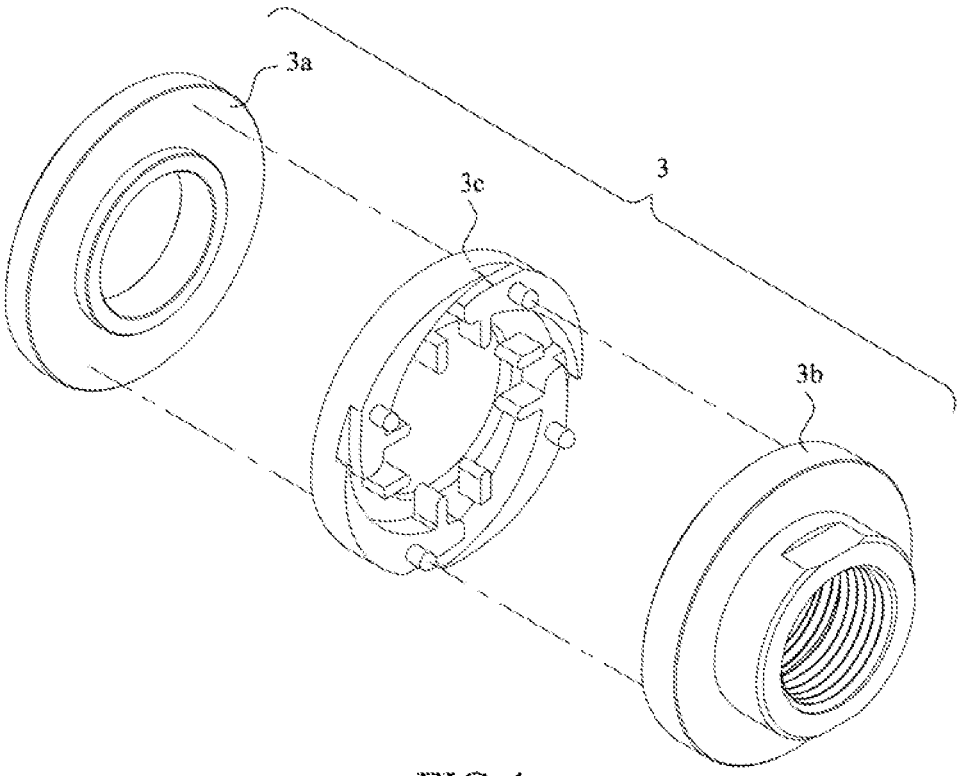
FIG. 4 is a perspective view illustrating a rotary means.
Figure 5:
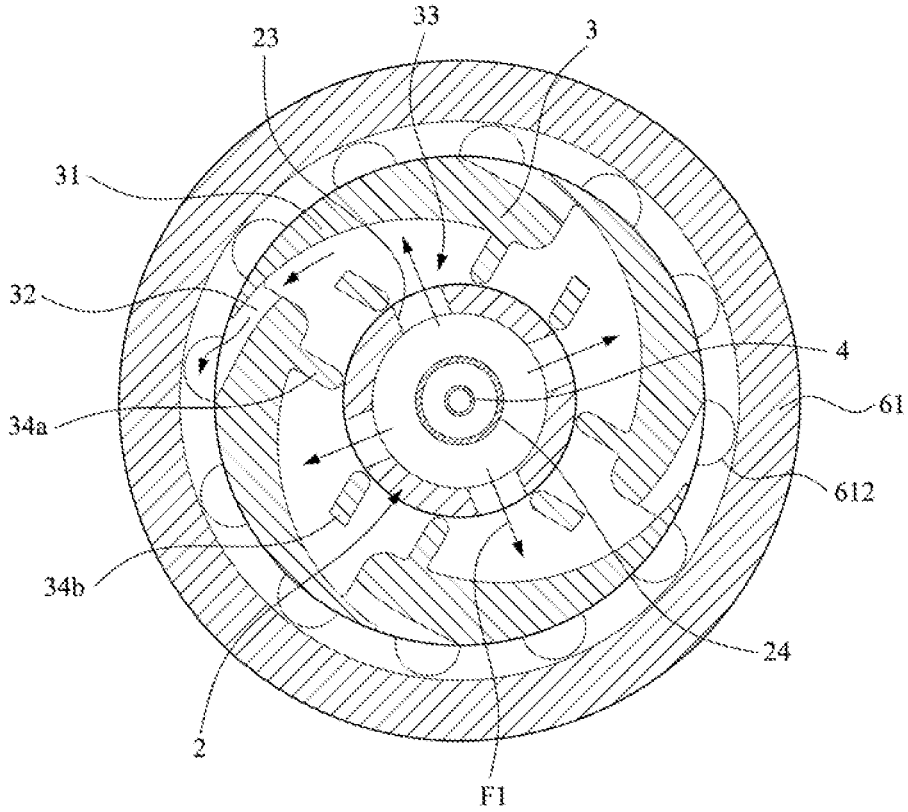
FIG. 5 is a cross-section view of the rotary means.

Please further refer to FIGS. 4 and 5. FIG. 4 is a perspective view illustrating a rotary means and FIG. 5 is a cross-section view of the rotary means. The rotary means 3 in this embodiment includes a front fastening layer 3*a*, a back fastening layer 3*b*, and a flow channel layer 3*c* disposed therebetween. Because the front fastening layer 3*a* and the back fastening layer 3*b* have a simple configuration shaped as a disk defining a disk surface therein, both of them may be made of a rigid material such as a metal material, an acrylic resin material, or the like. The flow channel layer 3*c* has a complex configuration also shaped as a disk defining a disk surface therein so it is preferred to be made of a plastic material such as a plastic, a rubber, or the like. After installation, the flow channel layer 3*c* is disposed side by side with the front fastening layer 3*a* and the back fastening layer 3*b*. The disk surface defined in the flow channel layer 3*c* is parallel to the disk surfaces respectively defined in the front fastening layer 3*a* and the back fastening layer 3*b*, and is orthogonal to the fluid tube 2. By such way in material selection, it makes the rotary means 3 being easy in manufacture. However, the present invention is not limited to this, and the flow channel layer 3*c* may be made of a rigid material as well.

The rotary means 3 is coupled with the fluid tube 2. A plurality of through holes 23 are provided on a tube wall of the fluid tube 2 for connecting with the rotary means 3. Further, the fluid tube 2 is also provided inside with a splitter 24. The splitter 24, which is a tube in this embodiment, is disposed inside the fluid tube 2 for splitting the fluid tube 2 into two sections, and thus the fluid F1 will be split into two portions when flowing through the splitter 24. One portion of the fluid F1 flows to the spraying outlet 22 of the fluid tube 2 through the section adjacent to inside of the splitter 24, and the other portion of the fluid F1 flows to the through holes 23 of the fluid tube 2 through the section adjacent to outside of the splitter 24 and then flows into the rotary means 3 from the through holes 23.

The rotary means 3 is provided with a drive wall 31 inclining to a fluid output direction of the through hole 23 and an outflow passage 32 formed at an end of the drive wall 31. The fluid F1, which flows into the rotary means 3 through the through holes 23, flows through a flow space 33 to push the drive wall 31 and then flows out from the rotary means 3 through the outflow passage 32. During the above process, the drive wall 31 is driven and pushed by a force of the fluid F1 output from the through holes 23, so as to make the rotary means 3 rotating and also make the fluid tube 2 rotating with the rotary means 3.

Rotating direction of the rotary means 3 corresponds to an inclining direction of the drive wall 31. In this embodiment, the drive wall 31 is formed extending along an involute curve as illustrated in FIG. 5, so that the rotating direction of the rotary means 3 is a clockwise direction.

Note that although the number of the drive wall 31 in this embodiment is four, the present invention is not limited to this, and the number of the drive wall 31 can be one. In this case, the outflow passage 32 is formed between a front end and a rear end of the drive wall 31.

In addition, the rotary means 3 is provided with a plurality of fastening ribs 34*a* and 34*b* extending toward the fluid tube 2, which the fastening ribs 34*a* and 34*b* is used for fastening the fluid tube 2 to a rotary center of the rotary means 3 so as to decrease yaw error in rotation.

With the structure disclosed in the present invention, the fluid tube 2 can be rotated without power supplying. The rotary means 3 is stronger in structure and is easy in miniaturizing because the drive wall 31, the outflow passage 32, the flow space 33 and so on are formed inside the rotary means 3. Further, the rotary means 3 having such structure can be stable in rotating and rotate uniformly in high speed with low variation.

Figure 6:
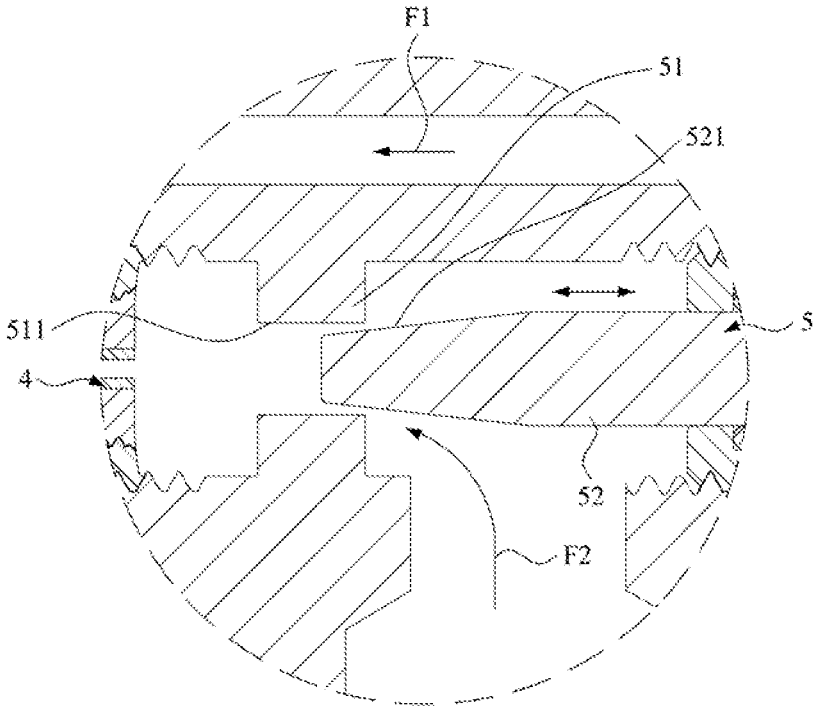
FIG. 6 is a cross-section view of a flow rate regulating means.

Please further refer to FIG. 6, which is a cross-section view of a flow rate regulating means. In this embodiment, the conveying tube 4 is further provided inside with a flow rate regulating means 5 in order to regulate flow rate of the fluid F2 conveyed through the conveying tube 4. The flow rate regulating means 5 includes a water stopper 51, a seal member 52, and a regulating member 53 (see FIG. 2). The water stopper 51 is formed with a flow hole 511 through which the fluid F2 in the conveying tube 4 can pass. The seal member 52 is formed at one end thereof with a decreasing section 521 movably disposed in the flow hole 511 of the water stopper 51 and the other end thereof extending out of the body 1 to assemble with the regulating member 53 (see FIG. 2). A thickness of the decreasing section 521 is less then that of the seal member 52. Depth of the decreasing section 521 of the seal member 52 being located in the flow hole 511 of the water stopper 51 can be adjusted by the regulating member 53, so that by changing the size of the gap between the flow hole 511 and the decreasing section 521, the flow rate of the fluid F2 which flows through the conveying tube 4 is regulated.

Figure 7:
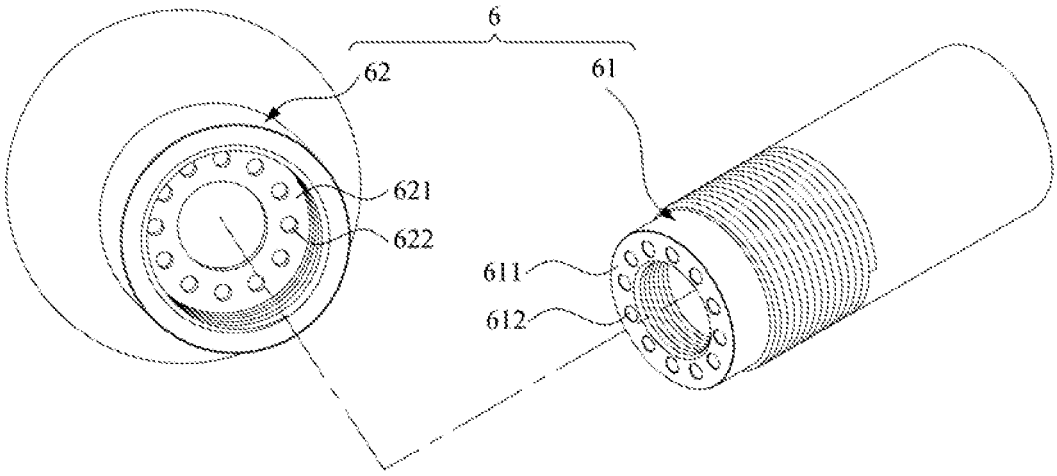
FIG. 7 is a perspective view illustrating a rotation speed adjusting means.
Figure 8:
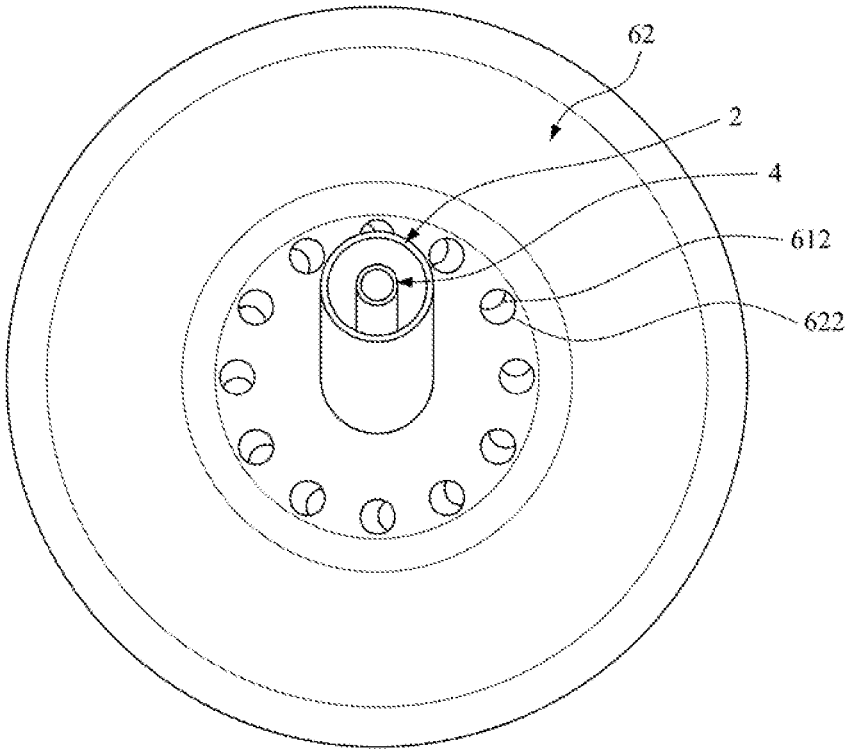
FIG. 8 is another perspective view illustrating the rotation speed adjusting means.

Please further refer to FIGS. 7 and 8. FIG. 7 is a perspective view illustrating a rotation speed adjusting means and FIG. 8 is another perspective view illustrating the rotation speed adjusting means. The rotary spraying device 100 is further provided with a rotation speed adjusting means 6 in order to adjust rotation speed of the fluid tube 2 and the rotary means 3. The rotation speed adjusting means 6 include a first adjusting member 61 and a second adjusting member 62. The first adjusting member 61 is connected with the outflow passage 32 of the rotary means 3 and has an outlet surface 611 formed with a plurality of first openings 612. Therefore, the fluid F1 output from the rotary means 3 will flow into the first adjusting member 61 and then output from the first openings 612. The second adjusting member 62 has an inlet surface 621 formed with a plurality of second openings 622 corresponding to the first openings 612. The inlet surface 621 of the second adjusting member 62 is coupled with the outlet surface 611 of the first adjusting member 61 to rotate with first adjusting member 61. With such structure, size of a connecting cavity of the first openings 612 and the second openings 622 can be changed by the relative rotation between the first adjusting member 61 and the second adjusting member 62. Thus, the flow rate of the fluid F1 output from the rotary means 3 can be adjusted, and the rotation speed of the rotary means 3 is determined based on the flow rate of fluid F1.

As can be appreciated from the above embodiments, the rotary spraying device of the present invention has industry worth which meets the requirement for a patent. The above description should be considered as only the discussion of the preferred embodiments of the present invention. However, a person having ordinary skill in the art may make various modifications to the present invention. Those modifications still fall within the spirit and scope defined by the appended claims.

What is claimed is:

1. A rotary spraying device comprising:

a fluid tube for a first fluid flowing therein, and provided at one end thereof with a fluid inlet for entry of the first fluid and the other end thereof with a spraying outlet, a through hole provided on a tube wall of the fluid tube;

a rotary means, coupled with the fluid tube, and forming a drive wall therein facing and inclining toward the through hole and an outflow passage formed at an end of the drive wall, a flow space formed between the through hole, the outflow passage and the drive wall, and the first fluid flowing within the flow space from the through hole toward the drive wall along a flowing direction of the first fluid away from the fluid tube and orthogonal to a tube-extending direction of the fluid tube;

a conveying tube provided at one end thereof with a fluid container inlet for connecting to a fluid container having a second fluid received therein, and an end portion of the conveying tube being disposed within the fluid tube to extend to the spraying outlet of the fluid tube so that the second fluid is conveyed toward the spraying outlet; and a rotation speed adjusting means including a first adjusting member and a second adjusting member, wherein the first adjusting member is connected with the outflow passage of the rotary means and has an outlet surface formed with a plurality of first openings and the second adjusting member has an inlet surface coupled with the outlet surface of the first adjusting member to be rotatable relative to the first adjusting member, and the inlet surface is formed with a plurality of second openings corresponding to the plurality of first openings;

wherein the first fluid flows between the fluid tube and the conveying tube from the fluid inlet toward the spraying outlet, and further flows into the rotary means through the through hole to drive the rotary means to rotate when the first fluid engages with the drive wall of the rotary means along the flowing direction thereof, the fluid tube is rotated along with the rotary means to rotationally spray the second fluid of the fluid container out of the rotary spraying device at the spraying outlet.

2. The rotary spraying device as claimed in claim 1, wherein the drive wall of the rotary means is formed as an involute curve surface extending away from the fluid tube along the flowing direction of the first fluid in the flow space.

3. The rotary spraying device as claimed in claim 1, wherein the rotary means is further provided with a plurality of fastening ribs extending toward the fluid tube along the flowing direction of the first fluid in the flow space.

4. The rotary spraying device as claimed in claim 1, wherein the rotary means includes a front fastening layer, a back fastening layer, and a flow channel layer disposed therebetween.

5. The rotary spraying device as claimed in claim 4, wherein the front fastening layer and the back fastening layer are made of a rigid material and the flow channel layer is made of a plastic material.

6. The rotary spraying device as claimed in claim 1, wherein the fluid tube is further provided inside with a splitter for splitting the first fluid flowing through the fluid tube into two portions, wherein one portion of the first fluid flows toward the spraying outlet of the fluid tube and the other portion of the first fluid flows toward and through the through hole of the fluid tube into the flow space.

7. The rotary spraying device as claimed in claim 1, wherein the conveying tube is further provided inside with a flow rate regulating means including a water stopper and a seal member, the water stopper is formed with a flow hole and the seal member is formed at one end thereof with a decreasing section movably disposed in the flow hole of the water stopper.

8. The rotary spraying device as claimed in claim 4, wherein the flow space is defined to be sandwiched between the front fastening layer and the back fastening layer, and is located within a surface defined by the flow channel layer, the defined surface of the flow channel layer is orthogonal to the fluid tube.

9. A rotary spraying device comprising:

a fluid tube for a first fluid flowing therein, and provided at one end thereof with a fluid inlet for entry of the first fluid and the other end thereof with a spraying outlet, and a through hole provided on a tube wall of the fluid tube;

a rotary means, coupled with the fluid tube to rotate with the fluid tube, the first fluid flowing from the through hole of the fluid tube into the rotary means to drive rotation of the rotary means;

a conveying tube provided at one end thereof with a fluid container inlet for connecting to a fluid container having a second fluid received therein, and an end portion of the conveying tube being disposed within the fluid tube to extend to the spraying outlet of the fluid tube so that the second fluid is conveyed toward the spraying outlet; and a flow rate regulating means disposed in the conveying tube, and comprising a water stopper and a seal member, the water stopper formed with a flow hole and located within the conveying tube for the second fluid of the fluid container flowing through the flow hole, the seal member formed at one end thereof with a decreasing section movably disposed in the flow hole of the water stopper, a distal end of the decreasing section being the slimmest part of the seal member;

wherein the first fluid flows between the fluid tube and the conveying tube from the fluid inlet toward the spraying outlet, and further flows into the rotary means through the through hole to drive the rotary means to rotate, the fluid tube is rotated along with the rotary means to rotationally spray the second fluid of the fluid container out of the rotary spraying device at the spraying outlet.

10. A rotary spraying device comprising:

a fluid tube for a first fluid flowing therein, and provided at one end thereof with a fluid inlet for entry of the first fluid and the other end thereof with a spraying outlet, and a through hole provided on a tube wall of the fluid tube;

a rotary means, coupled with the fluid tube to rotate with the fluid tube, the first fluid flowing from the through hole of the fluid tube into the rotary means to drive rotation of the rotary means;

a conveying tube provided at one end thereof with a fluid container inlet for connecting to a fluid container having a second fluid received therein, and an end portion of the conveying tube being disposed within the fluid tube to extend to the spraying outlet of the fluid tube so that the second fluid is conveyed toward the spraying outlet; and a rotation speed adjusting means comprising a first adjusting member and a second adjusting member, wherein the first adjusting member is connected with the rotary means and comprises an outlet surface formed with a plurality of first openings, the second adjusting member comprises an inlet surface coupled with the outlet surface of the first adjusting member to be rotatable relatively to the first adjusting member, and the inlet surface is formed with a plurality of second openings corresponding to the plurality of first openings, an overlapping opening size of each corresponding pair of the plurality of first and second openings is controlled by a rotating position of the second adjusting member relative to the first adjusting member;

wherein the first fluid flows between the fluid tube and the conveying tube from the fluid inlet toward the spraying outlet, and further flows into the rotary means through the through hole to drive the rotary means to rotate, the fluid tube is rotated along with the rotary means to rotationally spray the second fluid of the fluid container out of the rotary spraying device at the spraying outlet.

* * * * *